United States Patent [19]

Vita

[11] Patent Number: 4,596,968

[45] Date of Patent: Jun. 24, 1986

[54] WIDE FREQUENCY BAND DIFFERENTIAL PHASE SHIFTER WITH CONSTANT DIFFERENTIAL PHASE SHIFTING

[75] Inventor: Piero Vita, L'Aquila, Italy

[73] Assignee: Selenia Spazio, L'Aquila, Italy

[21] Appl. No.: 707,428

[22] Filed: Mar. 1, 1985

[30] Foreign Application Priority Data

Mar. 2, 1984 [IT] Italy ..... 47797 A/84

[51] Int. Cl.[4] ..... H01P 1/18

[52] U.S. Cl. ..... 333/157; 333/21 A; 333/33; 333/156

[58] Field of Search ..... 333/156, 157, 159, 21 A, 333/21 R, 33, 245, 248

[56] References Cited

U.S. PATENT DOCUMENTS

| | | | |
|---|---|---|---|
| 2,772,400 | 11/1956 | Simmons | 333/157 X |
| 3,118,118 | 1/1964 | Watts, Jr. | 333/248 X |
| 3,857,112 | 12/1974 | Epis | 333/21 A |
| 4,100,514 | 7/1978 | DiTullio et al. | 333/157 |

*Primary Examiner*—Marvin L. Nussbaum

*Attorney, Agent, or Firm*—Karl F. Ross; Herbert Dubno

[57] ABSTRACT

Differential phase-shifter operating in a wide frequency band, with constant differential phase shifting. This device is characterized by the fact that it produces a differential phase shift between two perpendicular polarizations, with constant frequency. This way, differential phase shifters with the desired flatness in the band can be obtained, either of 180° (polarizers for systems of linear polarization) or of 90° (polarizer for transforming the circular polarization into linear polarization and vice versa). Such a phase shifter can be used generally in antenna systems.

3 Claims, 4 Drawing Figures

WIDE FREQUENCY BAND DIFFERENTIAL PHASE SHIFTER WITH CONSTANT DIFFERENTIAL PHASE SHIFTING

FIELD OF THE INVENTION

The present invention relates to a wide frequency band differential phase shifter with constant differential phase shifting and, more particularly, to a device producing a differential phase shift with microwave signals polarized in two mutually perpendicular planes.

BACKGROUND OF THE INVENTION

Microwave or like signals polarized in two mutually perpendicular planes can be subjected to phase shifting in a waveguide-type of device. Phase-shifting devices for this purpose can be used in telecommunications, more particularly as polarized feeds or receivers for antennas, preferably terrestrial antennas, operating in satellite systems for the purpose of aligning the polarization plane (with a polarizer of 180°) received from the satellite with the polarization plane of the receivers, in the systems operating with linear polarization They also are usable for transforming circular polarization into linear polarization and vice versa (90° polarizer).

A phase shifter of this kind is preferably used in antenna illuminators (commonly known in the literature by the term "FEED").

The devices hitherto used for obtaining the desired phase shift employ the interposition of "irises" in a waveguide with orthogonal symmetry (square or circular guides).

These "irises" produce either a delaying or advancing effect for the waves of different polarizations.

It is known that a divider perpendicular to the axis in a waveguide of square or circular structure generates a capacitive effect for those polarizations which are perpendicular to the divider, while generating an inductive effect for a polarization wave parallel thereto.

These capacitive and inductive effects vary in degree with the frequency.

By combining these two effects and by choosing the right dimensions and number of lamellae it is possible to obtain the desired differential phase shift over a band of limited frequency range.

Such prior art polarizers cannot be effectively used for the transmission and the reception bands in satellite communication systems, which are known to be especially wide and distantly separated frequency bands.

With conventional polarizers, moreover, there is often the need for rotating the entire illumination system (such as is the case in linear polarizations) and/or to operate with separate phase shift modes in the different frequency bands.

In the first case the weight of the mechanical structure of the illumination system is increased and the alignment operation is slowed.

In the second case the separation circuit is highly complex, leading to insertion losses over the entire illumination system.

OBJECTS OF THE INVENTION

It is the principal object of the present invention to provide an improved microwave waveguide differential phase shifter whereby the drawbacks described above are obviated.

Another object is to provide an improved wide-band differential phase shifter of relatively simple and inexpensive construction.

Yet a further object is to provide a phase shifter which is especially useful in satellite communications and which effects a particularly clean separation of the shifted phases over a wide frequency band and/or for frequencies in widely separated bands.

SUMMARY OF THE INVENTION

These objects and others which will become apparent hereinafter are attained, in accordance with the invention, in a differential phase shifter which comprises a body formed with a waveguide channel of generally rectangular cross section and having an intermediate section formed as a lamellar phase shifting portion with uniformly spaced lamellae partly projecting into the channel from opposite walls thereof and in pairs of opposing lamellae lying in planes perpendicular to the two planes of polarization of the waves which are to be shifted. In this portion of the phase shifter, all of the lamellae project the same distance into the channel.

At each end of this portion of the phase shifter the channel continues into respective adapters in which similar pairs of spaced apart lamellae are provided and with the same spacing as the pairs of lamellae in the aforementioned main portion of the phase shifter. In the adapters, however, the lamellae project into the channel to progressively decreasing extents away from the main portion.

Adjacent each of these adapters, the channel is continued into a respective compensator, each compensator being formed with a respective set of waveguide cavities running perpendicular to the axis of the structure and short-circuited at the ends thereof.

One of the compensators has its waveguide cavities formed in the walls of the channel which run perpendicular to the walls from which the lamellae project while the other of these compensators has its cavities formed in the walls of the channel from which the lamellae project.

Thus the differential phase shifter of the invention consists of a lamellar phase shifter portion or section, of two cavity-type compensators or compensator sections, and an assembly of adapters suitably systematized.

The present invention overcomes the described disadvantages, since its particular structure makes it possible to obtain the desired differential phase shift (for instance 90° or 180°) consistently over wide frequency bands (for instance bands such as used in transmission and reception in satellite telecommunication systems).

BRIEF DESCRIPTION OF THE DRAWING

The present invention will now be described in an illustrative but nonlimiting manner with reference to the accompanying highly diagrammatic drawing in which.

FIG. *2a* is a longitudinal section through the phase shifter;

FIG. *2b* is a section taken along the line IIb—IIb of FIG. *2a;* and

FIG. *2c* is a view in the direction of arrow IIc of FIG. *2a.*

SPECIFIC DESCRIPTION

Figure 1:
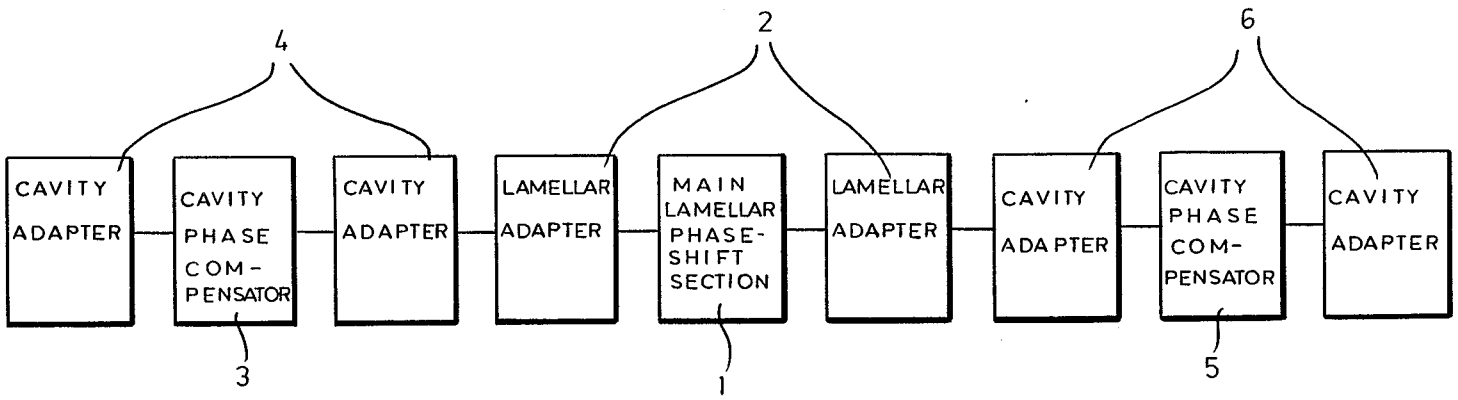
FIG. 1 is a block diagram illustrating the principles of the phase shifter of the invention.

As represented highly diagrammatically in FIG. 1, the phase shifter of the invention comprises a lamellar phase shifter or section 1 which is flanked by or connected at either end to respective lamellar phase shifter adapters 2.

Figure 2A:
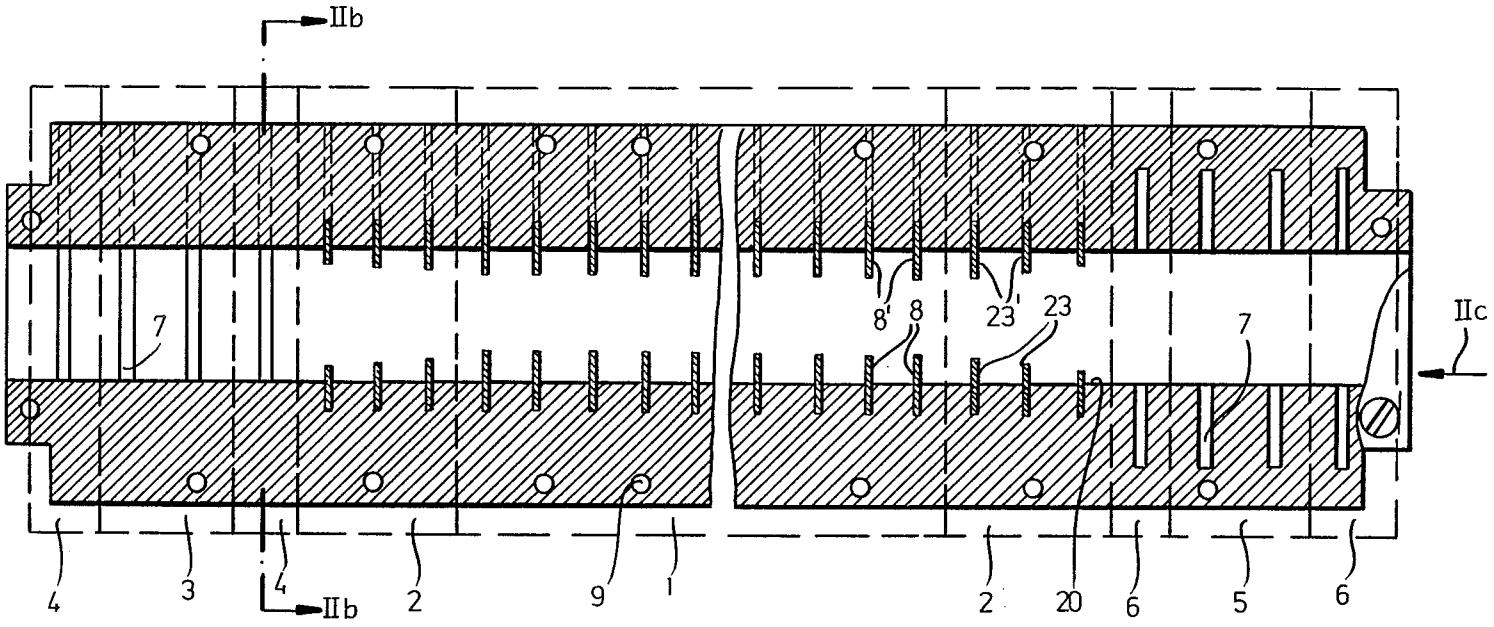

A cavity phase compensator 3 is connected to one of the adapters 2 and is provided with spaced-apart waveguide cavities perpendicular to the axis of the structure and with short circuits at the ends thereof, these cavities being formed in walls perpendicular to those from which lamellae project as will be apparent from FIG. 2*a*.

The cavity phase compensator 3 may be provided with adapters 4 providing a cavity matching to the compensator.

Similarly, phase compensator 5 with waveguide cavities perpendicular to the axis of the structure, short-circuited at their ends and formed in the walls provided with lamellae can be connected to the adapter 2 at the opposite end of the main phase shifter section 1. The cavity adapters 6 for the phase compensator 5 are here also shown.

FIG. 2*a* shows a longitudinal section of the differential phase shifter in which the same numerals are used to designate structures forming the function blocks in FIG. 1.

Here the lamellar phase shifter 1 can be seen to be provided with pairs of lamellae 8, 8' spaced apart along the channel 20 and projecting from opposite walls 21, 22 into the channel 20 which is of square cross section. All of the lamellae 8, 8' project to a similar extent into the channel. In the lamellar phase shifter adapters 2, however, the lamellae 23, 23' are provided similarly in pairs but are of progressively diminishing height away from the lamellar shifter 1.

Compensators 3 and 5 are formed with waveguide cavities 7' and 7 as are their respective adapters 4 and 6. The adapter and compensator cavities are spaced similarly to the pairs of opposing lamellae and the cavities of the adapters are narrower than those of the compensators. The short circuiting portions at the ends of the cavities 7' (FIG. 2b) are represented at 24, 24'. It will be understood that similar short circuiting portions are provided for the cavities 7. The signal can pass through the body axially in either direction.

Figure 2C:
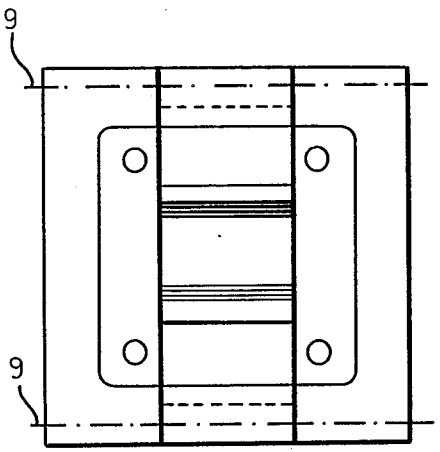
Figure 2B:
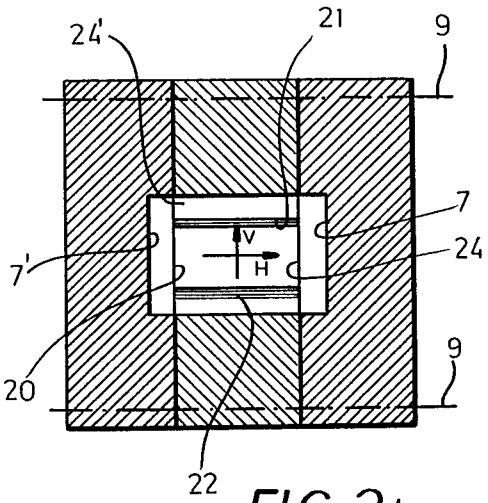

The phase shifter of FIGS. 2*a*–2*c* thus consists of a square guide made of four distinctive parts connected with screws (represented only by dot-dash lines) passing through the holes 9.

In its preferred embodiment the device according to the invention functions as follows:

An electromagnetic wave polarized according to the plane V, (FIG. 2*b*) passing through the described structure, undergoes a phase delay due to the effect of the series of lamellae 8, while an electromagnetic wave polarized corresponding to plane H (FIG. 2*b*) experiences, due to the same lamellae, a phase advance. The combined effect of phase-advance and phase-retardation produces a differential phase-shifting between the polarizations, according to the planes V and H, variable with the frequency.

By suitably proportioning the dimensions and the number of lamellae, a rate of differential phase shifting (between the two polarizations) is obtained, which presents a minimum value in the band of interest, reaching the desired value at the extremity of the frequency band used. The series of cavities 7 of compensator 5 presenting an electrical length $\lambda/4$ at the highest frequency of interest generates an effect of the inductive type for the polarization in plane V, while the polarization in plane H is not coupled by cavities of compensator 5.

The series of cavities 7' of compensator 3 presenting an electrical length between $\lambda/4$ and $\lambda/2$ in the band of interest generates an effect of the capacitive type for the polarization in plane H, while the polarization in plane V is not coupled by the series of cavities of the compensator 3.

The sum of the effects generated by the series of cavities of the compensators 3 and 5 makes it possible to obtain a rate of differential phase-shifting in this part similar to that obtained with the lamellar structure of main shifter section 1.

By suitably dimensioning each of the two series of cavities, a differential phase shift is obtained which, added to the one obtained by the structure 1, produces a constant value of differential phase-shifting over a very wide band. Each of the structures constituting the differential phase shifter can be separately adapted with cavities having the same length to adapt a narrower one for the structures 3 and 5, while for the lamellar structure 1 an assembly of lamellae of decreasing height can be used. In the above-described embodiment the phase shift introduced by the adapters is of course also considered. In the selection of the lamellae as well as of the cavities, the actual physical dimensions and the possible effects of parasitic phenomena and/or of proximity must also be considered.

The present invention greatly improves and/or simplifies the circuit arrangements for illuminators operating with antennas which form parts of wide frequency band communication systems.

I claim:

1. A differential phase shifter comprising an elongate body formed with a throughgoing waveguide channel of rectangular cross section and having:

an intermediate section formed as a lamellar phase-shifting portion with uniformly spaced lamellae partly projecting into said channel from only two opposite walls thereof and in pairs of opposing lamellae lying in planes perpendicular to a propagation direction of waves having two mutually perpendicular planes of polarization, all of said lamellae projecting by the same distance into said channel;

respective lamellar adapters at each end of said portion and into which said channel continues, each of said adapters having respective pairs of lamellae projecting from said two walls of said channel and spaced apart along the channel by the same spacing as that of the pairs of lamellae of said section; and respective phase compensators connected to each of said adapters and into which said channel continues, one of said phase compensators having spaced apart pairs of waveguide cavities formed in said two walls from which said lamellae project and perpendicular to a longitudinal axis of said body, the other of said phase compensators having spaced apart pairs of waveguide cavities formed in the other wall of said channel perpendicular to said longitudinal axis, all of said cavities being short-circuited at their ends.

2. The differential phase shifter defined in claim 1, further comprising a respective cavity-waveguide adapter between each of said compensators and a respective one of said lamellar adapters.

3. The differential phase shifter defined in claim 2, further comprising a respective cavity-waveguide adapter connected to each of said compensators at a side thereof opposite said section.

* * * * *